US005358383A

United States Patent [19]

Eisenbacher et al.

[11] Patent Number: 5,358,383

[45] Date of Patent: Oct. 25, 1994

[54] RADIAL-PISTON PUMP FOR INTERNAL COMBUSTION ENGINE FUEL

[75] Inventors: Egon Eisenbacher, Karlstadt; Bernhard Arnold, Roden-Ansbach; Franz Pawellek, Hafenlohr, all of Fed. Rep. of Germany

[73] Assignee: Elasis Sistema Ricerca Fiat Nel Mezzogiorno, Pomigliano D'Arco, Italy

[21] Appl. No.: 52,340

[22] Filed: Apr. 23, 1993

[30] Foreign Application Priority Data

Apr. 27, 1992 [DE] Fed. Rep. of Germany ..... 4213781
Apr. 27, 1992 [DE] Fed. Rep. of Germany ..... 4213798

[51] Int. Cl.[5] ..... F04B 21/00; F04B 1/04

[52] U.S. Cl. ..... 417/569; 417/273

[58] Field of Search ..... 417/569, 570, 571, 273; 137/512.3, 533.13, 539, 543.19

[56] References Cited

U.S. PATENT DOCUMENTS

| | | | |
|---|---|---|---|
| 2,306,818 | 12/1942 | King | 417/569 |
| 2,472,355 | 6/1949 | Whittingham | 417/273 |
| 2,642,748 | 6/1953 | Widmer | 417/465 |
| 3,849,032 | 11/1974 | Mulvey et al. | 137/543.19 |
| 3,912,421 | 10/1975 | Gelin | 417/273 |
| 4,530,319 | 7/1985 | Monda | 137/533.13 |
| 5,131,818 | 7/1992 | Wittkop et al. | 417/273 |
| 5,178,184 | 1/1993 | Skillman | 137/533.13 |
| 5,253,987 | 10/1993 | Harrison | 137/543.19 |
| 5,277,553 | 1/1994 | Stolpp | 417/273 |

FOREIGN PATENT DOCUMENTS 0299337 1/1989 European Pat. Off. .

*Primary Examiner*—Richard E. Gluck
*Assistant Examiner*—Peter Korytnyk
*Attorney, Agent, or Firm*—Ladas & Parry

[57] ABSTRACT

A pump having a number of radial cylinders each housing a sliding piston. Each cylinder is closed by a respective head, and comprises an intake valve and a delivery valve having respective seats inside a plate. The intake valve is located at the end of an intake channel having a first portion through the plate, a second portion formed between the head and the plate and perpendicular to the axis of the cylinder, and a third portion parallel to the cylinder axis. The delivery valve presents a truncated-cone-shaped seal communicating with the pumping chamber via a conduit also extending through the plate; and the two plungers are made of ceramic and guided by a respective retainer.

16 Claims, 3 Drawing Sheets

RADIAL-PISTON PUMP FOR INTERNAL COMBUSTION ENGINE FUEL

BACKGROUND OF THE INVENTION

The present invention relates to a radial-piston pump, particularly for internal combustion engine fuel.

EP-A2-0 299 337 relates to a radial-piston pump wherein the intake valve of each cylinder is coaxial with the cylinder, and the valve seat is formed in the head closing the cylinder. Fuel is supplied to the intake valve by a channel comprising various portions located in the head, the cylinder and the shell of the pump. A first of these portions consists of a hole in the head, and is coaxial with the cylinder. Another consists of a transverse hole, perpendicular to the cylinder axis, and terminates inside the first portion, so that the hole must be formed externally in the head and plugged outwards. A third portion of the intake channel is parallel to the cylinder axis and, through the cylinder, extends inside the head and into the transverse hole.

The cylinder head of the above known pump is normally screwed to the shell of the pump, so that it must be made of relatively soft, flexible material, whereas the valve seat must be made of relatively hard material to prevent premature wear. If the valve seat is located on the head, this must be locally hardened and is thus subject to breakage. Finally, the valves of the above known pump are located in large-volume, high-cost construction parts, thus resulting in high-cost repair in the event of valve failure.

SUMMARY OF THE INVENTION

It is an object of the present invention to provide a perfected radial-piston pump of the aforementioned type, designed to enable straightforward, low-cost manufacture.

According to the present invention, there is provided a pump having a number of radial cylinders, each housing a radially-sliding piston; each said cylinder being inserted inside a shell, and being closed by a respective head; a valve plate with two flat parallel surfaces being located in a recess in said head, towards said cylinder; said plate presenting a first seat for an intake valve, and a second seat for a delivery valve; and said first seat being located at a first portion of an intake channel extending through said two surfaces; characterized by the fact that said intake channel comprises a second portion formed between said head and said plate and substantially perpendicular to the axis of said cylinder.

The valve seat plate therefore also provides for simplifying manufacture of the intake channel, by virtue of the transverse portion of the channel no longer having to be formed externally in the cylinder head, and by virtue of the relative hole no longer being plugged, thus ensuring against fuel leakage from the cylinder.

According to a further characteristic of the present invention, the two valve seats are formed through a steel plate, and each of the plungers is housed in a retainer locked by the plate; at least one of the plungers being made entirely of a single ceramic material.

BRIEF DESCRIPTION OF THE DRAWINGS

A number of preferred embodiments of the present invention will be described by way of example with reference to the accompanying drawing, in which.

DETAILED DESCRIPTION OF THE INVENTION

Figure 1:
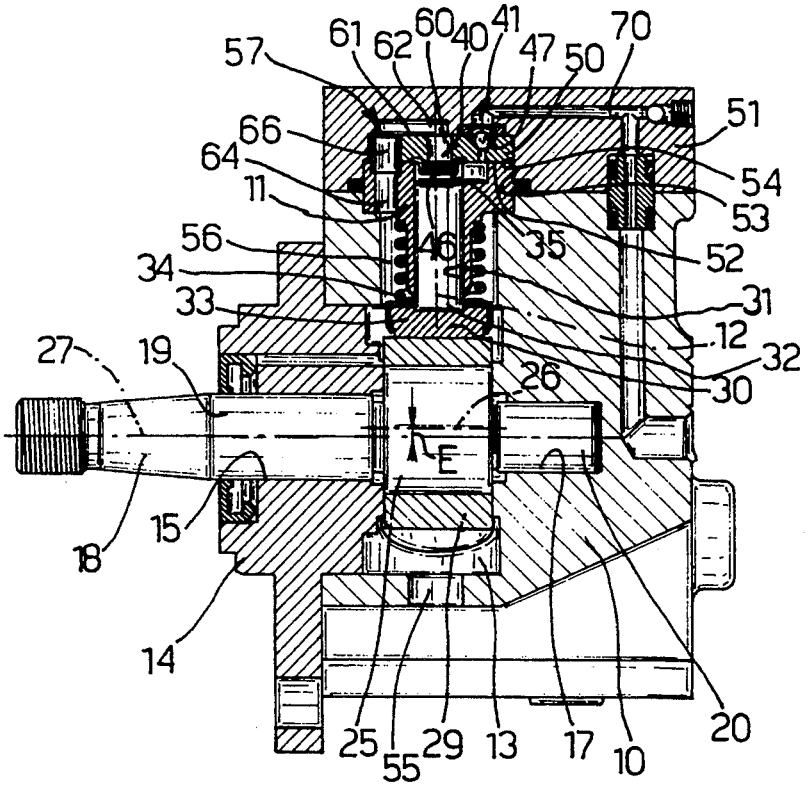
FIG. 1 shows a longitudinal section of a radial-piston pump according to a first embodiment of the present invention.

The radial-piston pump according to the present invention presents three cylinders 11 (only one shown in FIG. 1) having respective axes 12, and equally spaced radially at an angular distance of 120° inside a shell 10. Shell 10 forms a bowl-shaped chamber 13 closed by a flange 14 and housing a pump drive shaft 18 comprising two portions 19 and 20 rotating respectively inside a hole 15 in flange 14 and a dead hole 17 in shell 10.

Between portions 19 and 20, shaft 18 presents a cylindrical cam 25, the axis 26 of which is offset by eccentricity E in relation to axis 27 of shaft 18. Cam 25 presents an inner rotary control disk 29, the peripheral surface of which presents three flat portions 30 equidistant from axis 26 of cam 25, equally spaced angularly on disk 29, perpendicular to respective axes 12, and forming an angle of 60° with the adjacent flat portion 30.

Each cylinder 11 presents a cylindrical inner chamber 31 coaxial with axis 12 and housing a respective piston 32 to a precise tolerance. The end of each piston 32 facing disk 29 is fitted with a pad 33, which is pushed against one of flat portions 30 by a coil spring 34 precompressed between pad 33 and a shoulder on cylinder 11.

When shaft 18 is rotated, axis 26 of disk 29 rotates about axis 27 of shaft 18, while the position of disk 29 is maintained by spring 34 holding pad 33 against flat surface 30. As such, each flat portion 30 moves parallel to itself about a circular path, and provides for moving each piston 32 back and forth inside respective chamber 31.

In chamber 31 of cylinder 11, the outer radial wall of each piston 32, i.e. the front wall opposite disk 29, defines an operating or pumping chamber 35, the volume of which varies according to the movement of piston 32. Fuel is thus drawn in as piston 32 slides towards axis 27, and is pumped under pressure during the return stroke of piston 32.

To control the above cycle, each cylinder 11 presents an intake valve 40 and a delivery valve 41, each comprising a plunger 42, 43 (FIG. 2), a retainer 44, 45, and a valve seat 46, 47. Each cylinder 11 is closed outwards by a head 51 screwed to shell 10 to which the respective cylinder 11 is thus also secured.

Seat 46 is coaxial with cylinder 11, whereas seat 47 is offset in relation to axis 12. Both seats 46 and 47 are formed in a single valve plate 50 defined by two flat parallel surfaces 52 and 61, and fitted between the inner surface of head 51 of respective cylinder 11 and the surface of cylinder 11 facing head 51, as shown more clearly later on.

By appropriately sizing the thickness of plate 50, this is brought into precise contact with both cylinder and head 51. The outer surface 52 of plate 50 facing cylinder 11, and the surface of cylinder 11 facing surface 52 are accurately machined so that pumping chamber 35 is perfectly defined by plate 50.

Figure 2:
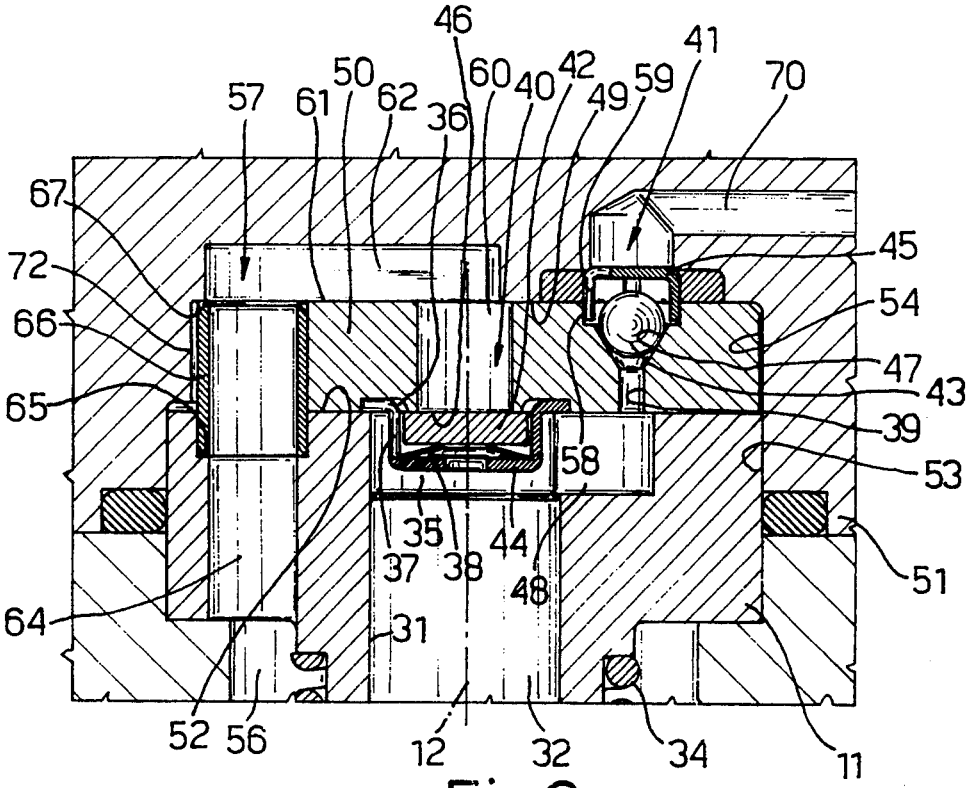
FIG. 2 shows an enlarged portion of FIG. 1.
Figure 3:
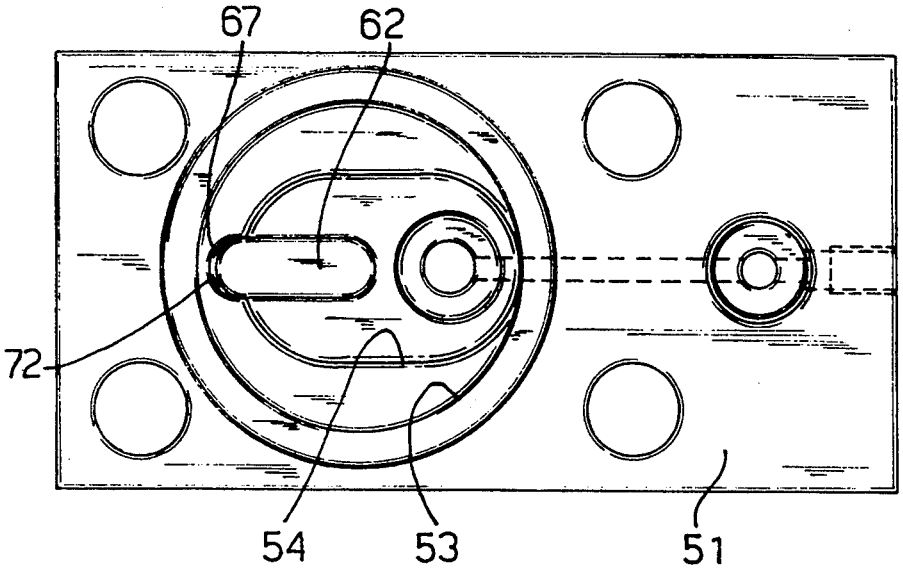
FIG. 3 shows an outward front view of a detail in FIG. 1 to a different scale.
Figure 4:
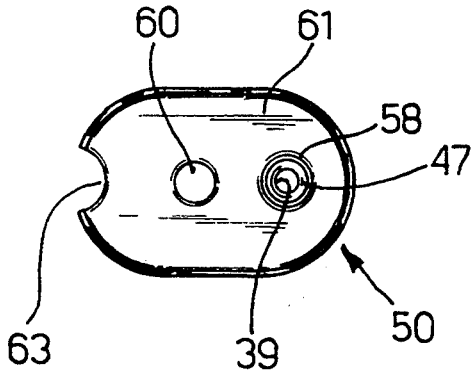
FIG. 4 shows an inward front view of a further detail in FIG. 1 to the same scale as in FIG. 3.

As shown clearly in FIGS. 1 and 2, cylinder 11 is housed partly inside a cylindrical recess 53 in head 51, and partly inside a respective recess in shell 10. Recess 53 extends axially into an oblong recess 54 formed in head 51 (FIGS. 3 and 4) and housing plate 50, the thickness of which is equal to the depth of recess 54.

Plate 50 presents a first through conduit 60 perpendicular to outer parallel surfaces 52 and 61 and coaxial with chamber 31. Seat 46 of intake valve 40 is flush with outer surface 52 of plate 50, surrounds conduit 60, and, on the cylinder 11 side, is engaged by plunger 42 consisting of a stopper plate.

Around seat 46, plate 50 presents an annular groove 36 housing a bowl-shaped retainer 44 enclosing plate 42 and having a number of flexible arms 37, the radial ends of which are preloaded radially and located inside groove 36. A Belleville washer or tapered helical spring 38 is also provided inside retainer 44, and pushes plate 42 against seat 46.

At seat 47 of delivery valve 41, plate 50 presents a second through conduit 39 also perpendicular to outer surfaces 52 and 61 of plate 50, and which flares towards surface 61 so as to form a substantially truncated-cone-shaped seat 47. Conduit 39 communicates with chamber 31 of cylinder 11 via a radial recess 48 in cylinder 11.

Plunger 43 is spherical in shape, is housed inside seat 47, and is movable towards head 51 and guided by retainer 45 which acts as a limit stop. Retainer 45 is also bowl-shaped, and presents a number of flexible arms 59, the radial ends of which engage a further annular groove 58 in plate 50, adjacent to seat 47.

The preload of arms 37 of retainer 44 and arms 59 of retainer 45 is sufficient to keep retainers 44, 45, plungers 42, 43, and spring 38 connected to plate 50, so that plate 50, together with valves 40 and 41, forms a preassemblable unit. Following assembly of the pump, the ends of flexible arms 37 of retainer 44 are gripped between cylinder 11 and plate 50, thus holding retainer 44 in position; and, similarly, retainer 45 is held in position by being gripped between plate 50 and head 51. As such, retainers 44 and 45 in no way prevent plate 50 from being connected to cylinder 11 and head 51.

Fuel is supplied to intake valve 40 (FIG. 1) via a hole 55 (FIG. 1) in shell 10, chamber 13, a chamber 56 about cylinder 11 in shell 10, and an intake channel 57 comprising a first portion consisting of conduit 60 in plate 50, coaxial with axis 12, and a second portion 62 communicating with first portion 60 and parallel to plate 50. Portion 62 is formed between head 51 and plate 50, and consists of a depression 62 formed in recess 54 of head 51.

As shown in FIG. 2, depression 62 covers almost the whole of first portion 60, from which it extends radially outwards and almost flush with recess 54, and is therefore covered by surface 61 of plate 50, with the exception of the cross section of portion 60 and a recess 63 (FIG. 4) on the lateral edge of plate 50.

Channel 57 also comprises a third portion 64 parallel to axis 12, housed inside cylinder 11 and head 51, and therefore communicating with second portion 62. Close to head 51, the hole forming third portion 64 inside cylinder 11 is larger in diameter, so as to form a step 65 constituting a seat and axial stop for a sleeve 66, the thickness of which equals the width of step 65. Sleeve 66 is inserted inside said hole, and extends between recess 63 in plate 50 and one end of recess 54, and just short of surface 61 of plate 50.

Depression 62 only extends radially as far as the inner surface of sleeve 66, so that, on a level with surface 61 of plate 50, it forms, in head 51., a further axial stop 67 for sleeve 66. The distance between stops 65 and 67 is slightly more than the length of sleeve 66, so as to define the axial position of sleeve 66.

Recesses 53, 54 and depression 62 are conveniently bored or milled on head 51. To obtain depression 62 and form the gap for insertion of sleeve 66 using a single milling cutter, the width of depression 62 must be substantially equal to the diameter of sleeve 66. To form stop 67 (FIG. 3) in the radial end 72 of depression 62, after forming depression 62, the tool is backed up by the height of depression 62, so that stop 67 is formed as a continuation of depression 62.

Sleeve 66 (FIG. 2), which performs no fuel supply function to intake valve 40, provides for positioning cylinder 11 in a predetermined angular position inside recess 53 in head 51, plate 50 already being inserted inside recess 54, and therefore provides for angularly positioning cylinder 11 in relation to plate 50 and head 51.

Figure 5:
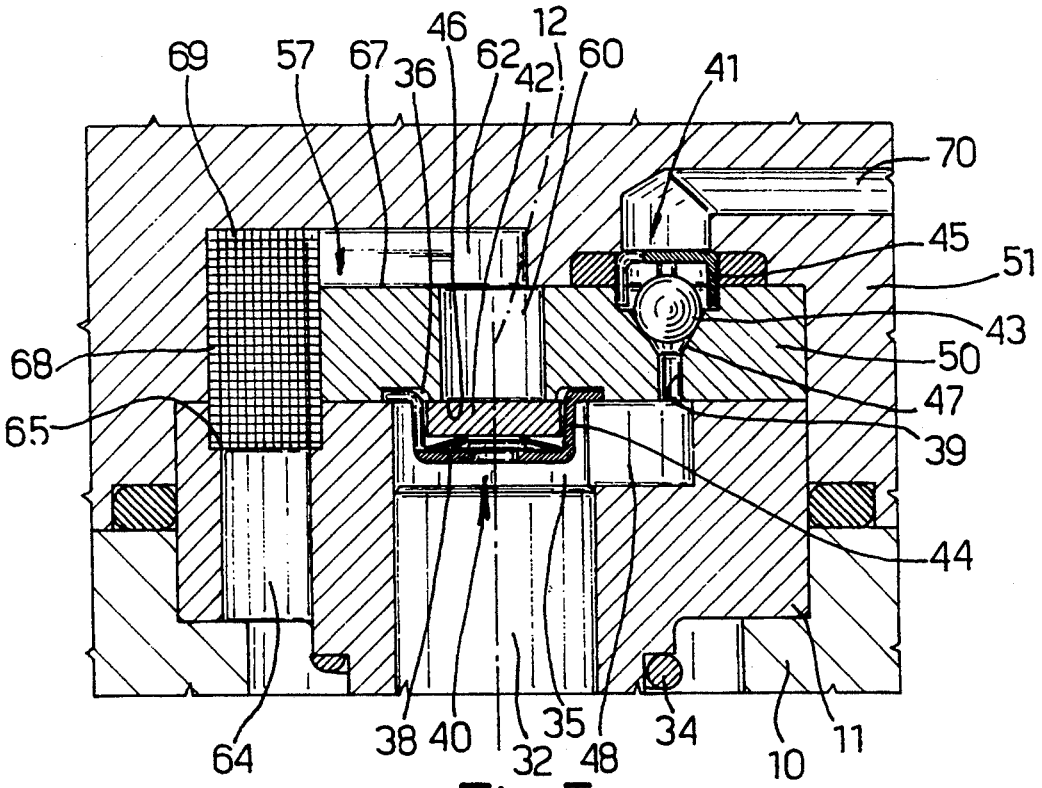
FIG. 5 shows a partial section as in FIG. 2 according to a further embodiment of the present invention.

In the FIG. 5 embodiment of the pump, shell 10, cylinders 11, head 51 and plate 50 of each cylinder 11 are similar to those of the FIGS. 1–4 pump. Intake channel 57 again comprises three portions 60, 62 and 64, but, as opposed to a sleeve, the third portion 64 houses a cylindrical fuel filter 68, the bottom edge of which rests on step 65 of cylinder 11, and the end 69 of which is inserted inside, and rests against the end wall of, depression 62.

In this case, filter 68 provides for correctly positioning cylinder 11 for insertion inside head 51, and is fitted axially inside cylinder 11, between step 65 and the end wall of depression 62, so that no stop is required on a level with outer surface 61 of plate 50. Depression 62 is therefore slightly longer than in the FIG. 1 embodiment, and fully covers the flared portion of the hole in cylinder 11 forming portion 64.

In FIGS. 1, 2 and 5, piston 32 is shown in the top dead center position. When pump shaft 18 is rotated, piston 32 moves down, thus increasing the volume of chamber 35, and, by virtue of the vacuum so formed, closes delivery valve 41 and opens intake valve 40 in opposition to the action of spring 38, so that fuel is drawn in through hole 55 in shell 10, intake channel 57 and chambers 13 and 56, and into chamber 35 between the arms 37 of retainer 44.

Operating in reverse in the bottom dead center position, the compression formed in chamber 35 by piston 32 closes intake valve 40 and opens delivery valve 41, so that fuel is now fed through recess 48 and conduit 39, between arms 59 of retainer 45, and to a delivery conduit 70 in head 51.

For achieving a high degree of efficiency and long working life of the pump, it is important to provide for rapid response and preventing rapid wear of valves 40 and 41, for which purpose, plate 42 and ball 43 are made of silicon nitrite ceramic. This provides for less than half the mass of steel plungers of the same size and, hence, for rapid response, while, by virtue of plate 50 being made of steel, neither plungers 42 and 43 nor plate 50 are subject to appreciable wear.

As regards ball 43, this is controlled solely by the difference in pressure inside pumping chamber 35 and the delivery conduit, so that no return spring is required. By virtue of cylinders 11, in fact, a high stable pressure is maintained in conduit 70 during operation of the pump.

Figure 6:
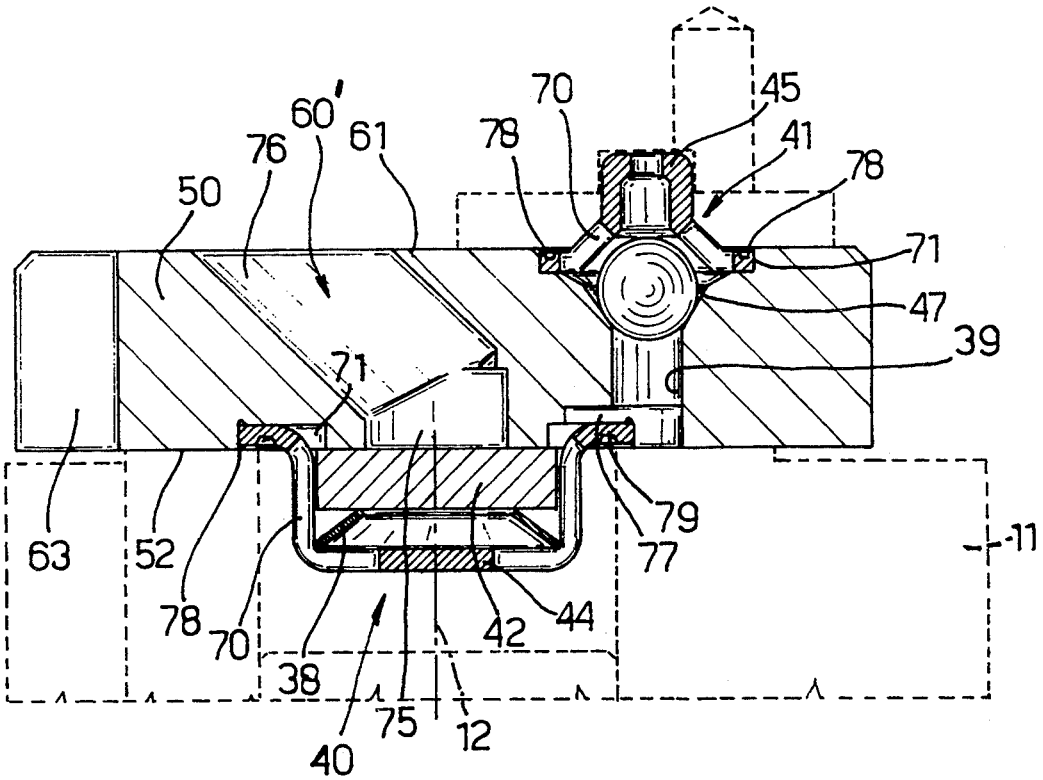
FIG. 6 shows a partial section as in FIG. 2 according to a third embodiment of the present invention.

In the FIG. 6 embodiment, only the preassembled unit consisting of plate 50 and valves 40 and 41 is shown; and conduit 39 of delivery valve 41 is formed in plate 50 closer to the axis 12 of cylinder 11, as shown by the dot-and-dash line.

Conduit 60' of the intake valve, on the other hand, presents a first hole portion 75 coaxial with axis 12 and formed in surface 52 of plate 50; and a second inclined portion 76 formed in surface 61. In surface 52 of plate 50, a recess 77 is formed between chamber 31 and conduit 39 and which corresponds with recess 48 in the FIG. 1–2 embodiment.

Retainers 44 and 45 are the same as in FIGS. 1 and 2, and present radial arms 70 constituting spokes connected to a respective outer ring 78 housed inside a respective groove 71 in plate 50 and locked axially therein by cylinder 11 and head 51, for which purpose, each ring 78 presents an annular groove 79.

The FIG. 6 embodiment operates in the same way as that of FIGS. 1–2, and therefore requires no further description.

The radial-piston pump according to the present invention therefore provides for easily forming not only depression 62 perpendicular to axis 12 but also portion 64 of channel 57 in head 51, by simply moving the milling tool appropriately in portion 64 of cylinder 11, with no need for an additional axial hole in head 51.

Further advantages of the present invention as compared with known pumps will also be clear from the foregoing description. In particular, by virtue of plate 50 being located in recess 53 in head 51, depression 62 may be formed later and inside head 51 only, with no need for machining plate 50, which is normally made of hardened material. Moreover, by virtue of third portion 64 of intake channel 57 being parallel to axis 12 of cylinder 11, effective sealing of cylinder 11 may easily be achieved by providing a seal about cylinder 11, in the wall separating shell 10 and head 51, thus preventing external fuel leakage.

Recess 63 in plate 50 provides for straightforward connection of depression 62 and portion 64, and means 66 and 68 for troublefree positioning of cylinder 11 and plate 50 for assembly inside shell 10. Filter 68 provides, on the one hand, for increasing the working life of the pump by eliminating any impurities in the fuel supplied to cylinders 11, and, on the other, for correctly positioning cylinder 11 inside shell 10.

By virtue of plate 50 presenting through channels between parallel surfaces 52 and 61, no transverse holes parallel to said surfaces are required, thus reducing both machining cost and the thickness of plate 50; retainers 44 and 45 provide for preassembling plate 50 and valves 40 and 41; and, finally, the use of ceramic plungers 42 and 43 provides for reducing wear on the plungers, as well as for increasing the response and operating frequency of the valves.

To those skilled in the art it will be clear that changes may be made to the pumps as described and illustrated herein without, however, departing from the scope of the present invention. For example, depression 22 may also be formed partly or wholly inside plate 50; changes may be made to the support of piston 11 on operating disk 29 or to retainers 44 and 45; provision may be made for only one ceramic valve; and/or changes may be made to the number and arrangement of pistons 11.

We claim:

1. A radial-piston pump, for internal combustion engine fuel, having a number of radial cylinders (11), each housing a radially-sliding piston (32); each said cylinder (11) being inserted inside a shell (10), and being closed by a respective head (51); a valve plate (50) with two flat parallel surfaces (52, 61) being located in a recess (54) in said head (51), secured by said cylinder (11); said plate (50) presenting a first seat (46) for an intake valve (40), and a second seat (47) for a delivery valve (41); and said first seat (46) being located at a first portion (60, 60') of an intake channel (57) extending through said two surfaces (52, 61); characterized by the fact that said intake channel (57) comprises a second portion (62) formed between said head (51) and said plate (50) and substantially perpendicular to the axis (12) of said cylinder (11).

2. A pump as claimed in claim 1, characterized by the fact that said second portion (62) consists entirely of a depression formed in said head (51); said first portion (60, 60') being coaxial with said axis (12).

3. A pump as claimed in claim 2, characterized by the fact that said first seat (46) is coaxial with said axis (12) and is engaged by a first plunger (42) moving towards said cylinder (11); said second seat (47) being offset in relation to said axis (12) and extending towards said head (51).

4. A pump as claimed in claim 3, characterized by the fact that said first portion consists of a first conduit (60, 60') in said plate (50) associated with said first seat (46); said plate (50) presenting a second conduit (39) associated with said second seat (47); and said conduits (60, 60'; 39) extending through said two parallel surfaces (52, 61).

5. A pump as claimed in claim 4, characterized by the fact that, in at least one of said cylinder (11) and said plate (50), there is provided a recess (48, 77) enabling communication between a cylindrical chamber (31) in said cylinder (11) and said second conduit (39).

6. A pump as claimed in claim 4, characterized by the fact that said first seat (46) is flat, is located on the outer surface (52) of said plate (50), and is engaged by a first plunger (42); said second seat (47) being conical, being formed in said plate (50), and being engaged by a spherical plunger (43).

7. A pump as claimed in claim 3, characterized by the fact that at least one of said first plunger (42) and/a second plunger (43) are each located in a retainer (44, 45) which is locked on to said plate (50); each said retainer (44, 45) presenting flexible radial arms (37, 59) engaging a respective groove (36, 58) in said plate (50).

8. A pump as claimed in claim 7, characterized by the fact that at least one of said plungers (42, 43) is made entirely of a single ceramic material; said plate (50) being made of steel.

9. A pump as claimed in claim 8, characterized by the fact that both said plungers (42, 43) are made of ceramic material.

10. A pump as claimed in claim 8, characterized by the fact that at least said ceramic plunger (43) is controlled solely by the difference in pressure at the inlet and outlet of the respective valve (41).

11. A pump as claimed in claim 3, characterized by the fact that at least one of said first plunger (42) and/a second plunger (43) are each located in a retainer (44, 45) which is locked on to said plate (50); each said retainer (44, 45) presenting a ring (78) connected to a number of spokes (70); and each ring (78) being inserted inside a respective groove (71) in said plate (50).

12. A pump as claimed in claim 1, characterized by the fact that a third portion (64) of said intake channel (57) is located substantially parallel to said axis (12); said third portion (64) being located partly inside said cylinder (11) and partly inside a recess (63) in said plate (50) and inside one end (72) of said recess (54).

13. A pump as claimed in claim 12, characterized by the fact that said plate (50) presents means (66, 68) for angularly positioning said cylinder (11) in relation to said plate (50) and said head (51); said means (66, 68) being located at said third portion (64) between said recess (63) and said end (72).

14. A pump as claimed in claim 13, characterized by the fact that said means (66, 68) comprise a sleeve (66) inserted in said recess (63) and in said end (72) and locked rigidly between two axial stops (64, 67) on said cylinder (11) and said head (51) for exactly defining the position of said sleeve (66).

15. A pump as claimed in claim 13, characterized by the fact that said means (66, 68) comprise a cylindrical fuel filter (68), the bottom (69) of which is located at the end wall of said second portion (62).

16. A pump as claimed in claim 15, characterized by the fact that one (67) of said stops (65, 67) is formed at said end (72) of said recess (54) as a continuation of said second portion (62), and is located at a distance from said cylinder (11) equal to the thickness of said plate (50).

* * * * *